US008342896B1

(12) United States Patent
Sardar

(10) Patent No.: US 8,342,896 B1
(45) Date of Patent: Jan. 1, 2013

(54) FLOTATION DEVICE WITH HAND-OPERATED PROPULSION STRUCTURE

(76) Inventor: Zuhdi A. Sardar, Thousand Oaks, CA (US)

( * ) Notice: Subject to any disclaimer, the term of this patent is extended or adjusted under 35 U.S.C. 154(b) by 157 days.

(21) Appl. No.: 12/925,228

(22) Filed: Oct. 18, 2010

(51) Int. Cl.
*B63H 16/20* (2006.01)

(52) U.S. Cl. ..... 440/27; 441/102

(58) Field of Classification Search ..... 440/21, 440/25, 26, 27; 441/102, 106
See application file for complete search history.

(56) References Cited

U.S. PATENT DOCUMENTS

| | | | | |
|---|---|---|---|---|
| 252,324 | A * | 1/1882 | McDonald | 440/26 |
| 1,218,909 | A * | 3/1917 | Sinkovich | 440/26 |
| 1,640,390 | A * | 8/1927 | Bacon | 440/27 |
| 3,180,306 | A * | 4/1965 | Gouedy | 440/26 |

* cited by examiner

*Primary Examiner* — Lars A Olson
(74) *Attorney, Agent, or Firm* — Allan M. Shapiro

(57) ABSTRACT

The flotation device with hand-operated propulsion structure comprises a hull with right and left hand cranks. The hand cranks are each connected to rotate its own propeller so that steering is achieved by different cranking and propulsion is achieved by cranking on both manual cranks. In addition to the hull with cranks and propellers, a survival suit is provided with corresponding attachment for the securement of flotation and propulsion devices thereto.

18 Claims, 4 Drawing Sheets

62
60
112
36
64
46
40
70
44
35
54
50
5
5
52
38
48
34
50

12
35
34
40
30
16
44
56
36
58

FLOTATION DEVICE WITH HAND-OPERATED PROPULSION STRUCTURE

BACKGROUND OF THE INVENTION

Passenger ships are equipped with lifeboats and life rafts. The lifeboats and life rafts are intended to be emergency boats for carrying the persons on the passenger ship should it have catastrophic failure. While the number of spaces in the lifeboats and life rafts is sufficient for the number of persons on the passenger ship, there is the organizational problem of getting the people to the lifeboats and life rafts. There are lifeboat drills, and the passengers are instructed as to what actions to take should an emergency occur. The passengers are instructed to don their flotation devices in the form of life jackets and report to a specific lifeboat station. Such lifeboat drills are usually successful. However, should an actual emergency occur, it is quite possible that some of the lifeboats and life rafts are unuseable. It is also possible that, in the confusion of the emergency event, the distribution of the persons to the lifeboats and life rafts may not be optimum, and some may be overloaded.

A life jacket may hold up a person in the water, but the person must escape from the sinking ship in order to avoid being pulled down in the turbulent waters resulting from the sinking of the ship. Thus, a life jacket is not enough since a certain amount of strength and knowledge about swimming is required in order to save oneself.

SUMMARY OF THE INVENTION

In order to aid in the understanding of this invention, it can be stated in essentially summary form that it is directed to a flotation device which has thereon propulsion structure which can be hand-powered by the user. The propulsion structure preferably includes two cranks connected to separate propellers so that cranking with both hands causes propulsion and cranking with one hand more than the other causes steering. In this way, a user can employ the flotation device to support himself in the water and to propel himself in and with the water.

It is thus a purpose and advantage of this invention to provide a flotation device which can be attached to a person to permit him to float in the water and without danger of losing the flotation device, together with a propulsion structure on the flotation device to permit him to move through the water and steer his way through the water.

It is another purpose and advantage of this invention to provide a thermal suit which provides the user with some insulation from the chilling properties of the water together with a flotation device which can be attached to the thermal suit.

It is another purpose and advantage of this invention to provide a flotation device which is propelled by propellers which are individually powered by the two hands.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
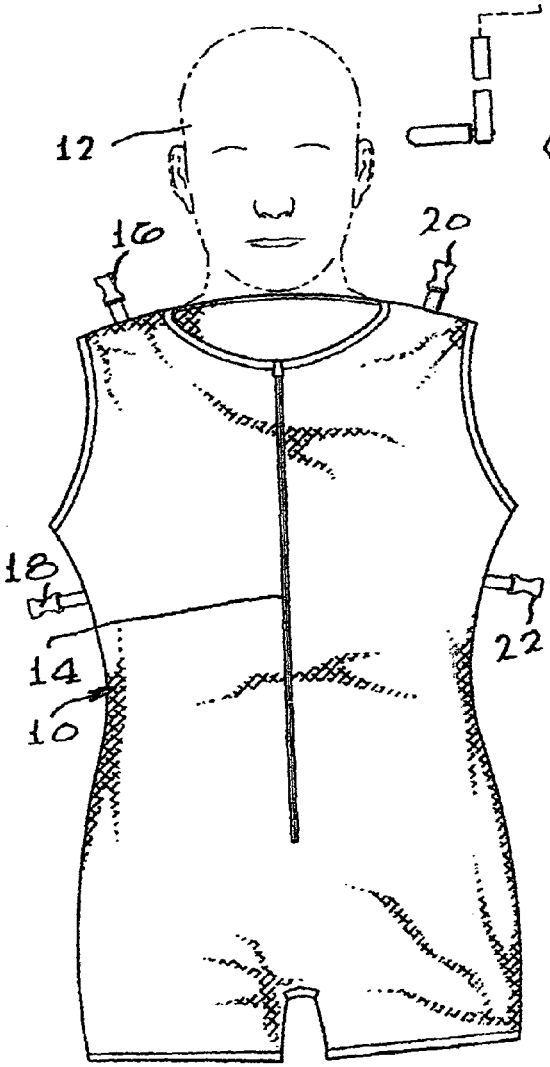
FIG. 1 is a front view of a survival suit suitable for attachment to a hand-operated propulsion structure in accordance with this invention.
Figure 2:
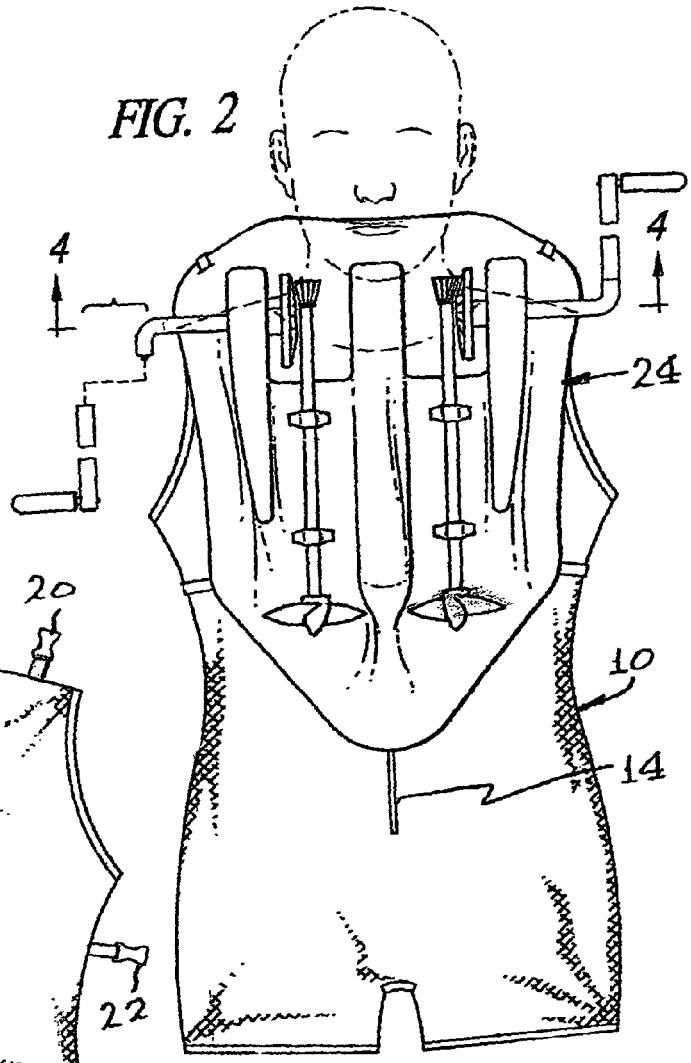
FIG. 2 is a front view of a survival suit with a hand-operated propulsion structure attached thereto, in accordance with this invention.
Figure 3:
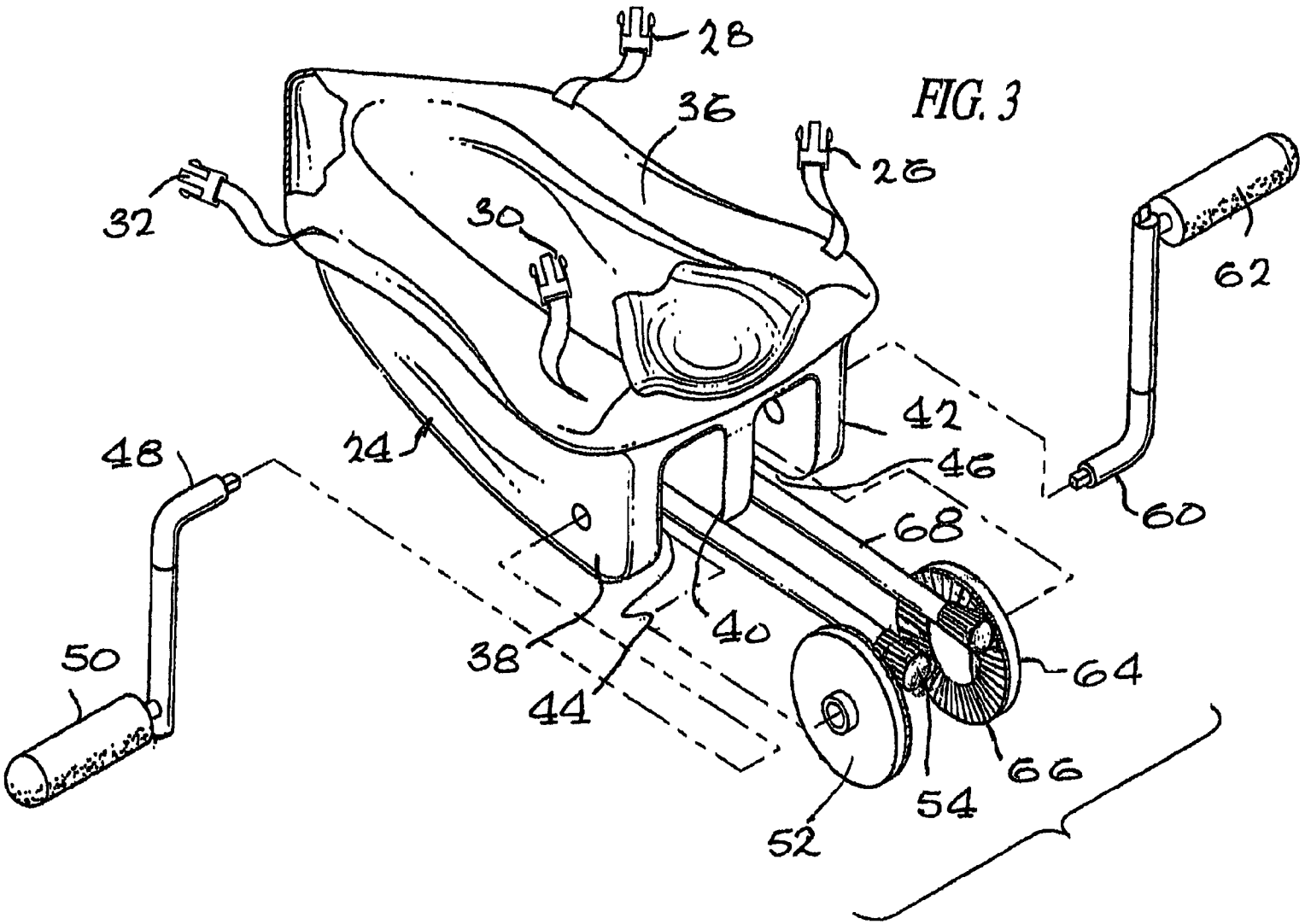
FIG. 3 is an isometric view of the hand-operated propulsion and flotation structure, with parts in the exploded position.
Figure 5:
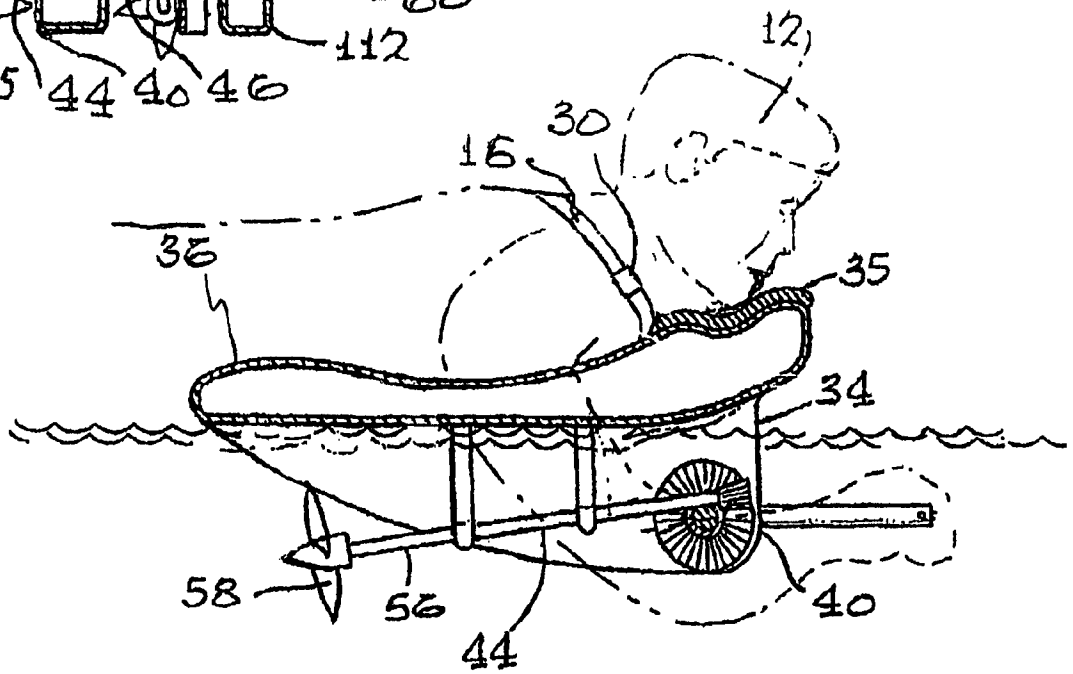
FIG. 5 is a longitudinal section taken generally along the line 5-5 of FIG. 4.

FIGS. 1 and 2 show survival suit 10 as being worn by a man 12, with only his head shown in dashed lines. The survival suit has a front closure 14 which permits the survival suit to be donned and doffed. The survival suit 10 is shown as being sleeveless and without leg covering. It may have both of those items. The survival suit is in the nature of an insulated suit which will protect the user against the cold of the water. It is structured so as to perform this function in the environmental conditions in which it will be used. The survival suit has four connectors 16, 18, 20 and 22 which are used for detachable attachment to the flotation device 24. Flotation device 24 has a hollow hull 34 having a top surface 36 which can be comfortably engaged by the man against his chest. Connectors 26, 28, 30 and 32, respectively, on the hull are disengageably connected with the connectors 16, 18, 20 and 22, respectively. The near side connectors are shown attached in FIG. 5.

Figure 4:
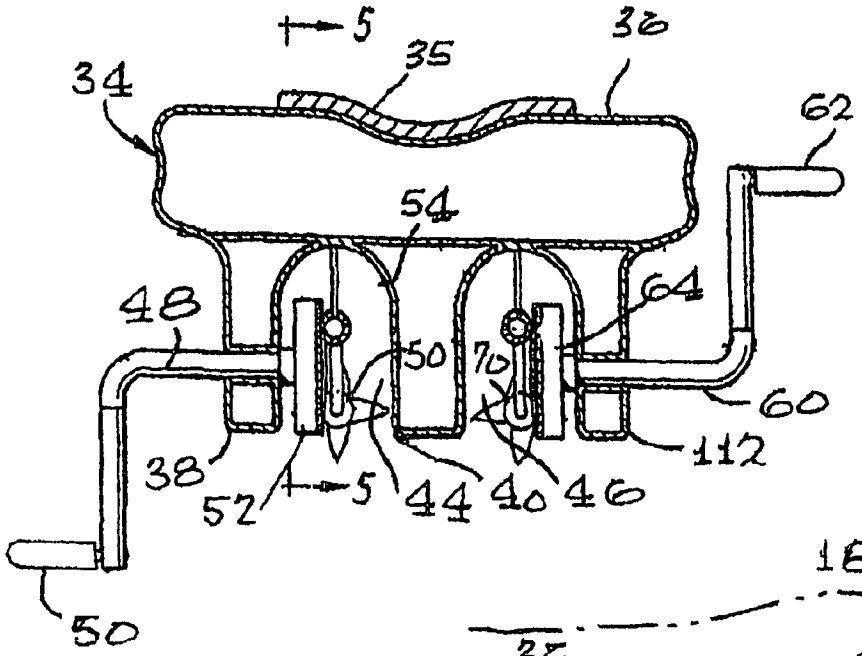
FIG. 4 is a section taken generally along line 4-4 of FIG. 2.

The upper platform of hull 34 is generally horizontal and rectangular, as seen in cross-section in FIG. 4. It carries downwardly directed keels 38, 40 and 42, which keels define tunnels 44 and 46 therebetween. The tunnels create a space for the machinery and help protect the propellers against damage. The top surface of the hull 34 is contoured so that it provides comfort. It carries chin cushion 35 to help hold the man's head out of water. The hull is the primary flotation device. It also carries the propulsion structure. The survival suit may also have flotation characteristics, but its primary purpose is to provide thermal insulation to the body. It may be a wet suit or a dry suit. When the survival suit is a dry suit, flotation volume is usually provided on the interior. The survival suit may provide partial or full flotation characteristics. A full dry suit is sufficiently large to utilize a standard life vest therein. The survival suit is primarily designed to be worn on the naked body. However, if provided for use during an emergency, the survival suit has to be oversized so it can be worn over normal clothing. It is the combination of the survival suit together with the primary flotation device—the hull—which provides the three elements necessary to aid in survival: flotation, insulation and propulsion.

Crankshaft 48 has a crank handle 50 thereon. The crank handle is freely rotative and has a soft grip thereon for ease of grasp. Crankshaft 48 extends through a bearing in keel 38, see FIG. 4. Interiorly of the keel, it carries face gear 52. Pinion 54 is in gear tooth engagement with the face gear 52. Pinion 54 is mounted on propeller shaft 56 (see FIG. 5). Since the pinion is smaller than the face gear and has fewer teeth on the pitch diameter than the face gear, one rotation of the face gear causes a plurality of rotations of the propeller shaft. Propeller 58 is mounted on the propeller shaft and rotates therewith. Rotation of the propeller causes forward thrust to move the hull in the forward direction toward the viewer in FIG. 4 and to the right of FIG. 5. The structure from the crank to the propeller thus described is in the right tunnel 44. A mirror image structure is also provided in the left tunnel 46. Crankshaft 60 carries crank handle 62. The crankshaft 60 extends through the keel 42 and carries face gear 64 in tunnel 46. Pinion 66 is in gear-tooth engagement with the face gear 64. Pinion 66 is mounted on propeller shaft 68. Propeller 70 is mounted on the rear of the propeller shaft 68. Turning of crankshaft 60 causes rotation of the propeller 70.

It can be seen that rotation of the right-hand crankshaft 48 causes the right propeller to turn. Rotation of the left crankshaft 60 causes the left propeller 70 to turn. The propeller shafts are mounted on struts in the tunnels underneath the hull 34 and are laterally offset from each other. Thus, cranking of one crank harder than the other causes more thrust on that side to cause the apparatus to steer.

In case of emergency, the man puts on his survival suit and then straps on his propulsion structure. When he goes into the water, he can separately crank the propellers. An additional advantage occurs for the case where one arm is injured or weaker than the other. The man can still get propulsive effort, but has more difficulty in choosing his direction of travel.

Figure 6:
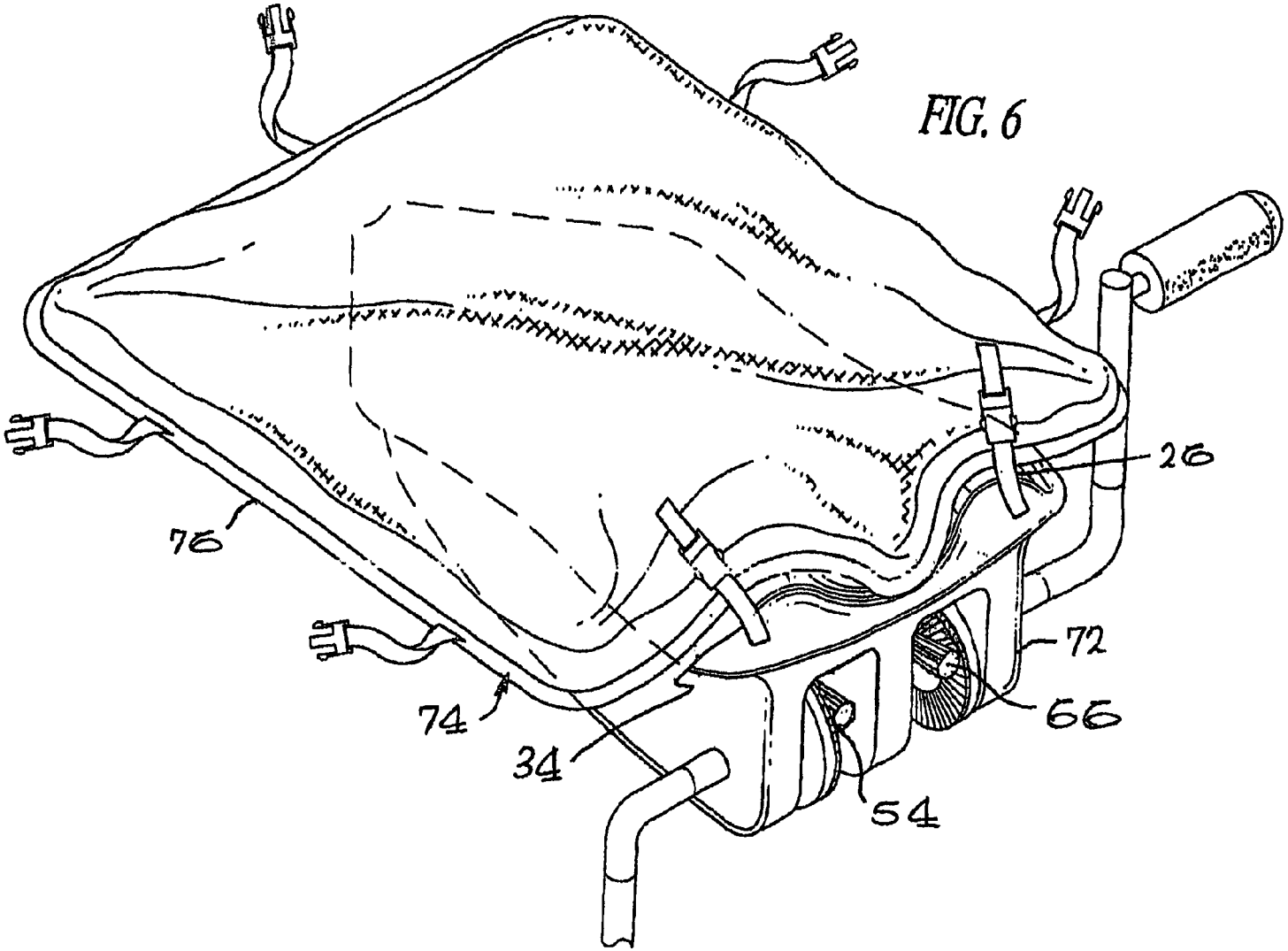
FIG. 6 is an isometric view of a similar structure, showing cushioning on the flotation device.

The hull 72, shown in FIG. 6, is the same as the hull 34 including its keels, cranks, gears and propellers. It also has the same connectors 26 and 34. The cushion 74 overlays the hull 72 and provides both cushioning and flotation. It is thus an addition to or instead of the chin cushion 35. The cushion 74 is of rectangular construction and has upper and lower fabric layers which are joined together at the selvedge edge 76. These fabric layers of the cushion need not be waterproof. Within the cushion between the top and bottom layers thereof is a layer of closed cell synthetic foam material which provides both the cushioning and the flotation. The edges of the cushion have connectors at the side edges and the crotch, which coincide with corresponding connectors in the survival suit. Only some of these connecters are shown in FIG. 1, but additional connectors would be provided on the survival suit to correspond to the connectors on the cushion. This flotation device with hand-operated propulsion structure also permits the user to be supported in the water and to provide for his own propulsion.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A flotation device comprising:

a hull, said hull having a density less than that of water so as to provide flotation;

manually engageable structure movably mounted on said hull and propulsion structure on said hull for propelling said hull, said manually engageable structure being connected to said propulsion structure so that motion of said manually engageable structure drives said propulsion structure, a plurality of connectors on said hull;

a survival suit configured to be worn by a person, said survival suit being insulated to reduce thermal loss from a person wearing the survival suit to a colder environment therearound, connectors on said survival suit, said connectors being releasably connected to said connectors on said hull.

2. The flotation device of claim 1 wherein said manually engageable structures are left and right cranks, said left and right cranks being connected to said propulsion structure.

3. The flotation device of claim 2 wherein said propulsion structure comprises first and second propelling devices at least partially submerged in water when said hull is floating on water and said first and second cranks are respectively connected to said first and second propelling devices so that said first and second propelling devices are individually powered by individual cranking of said cranks.

4. The flotation device of claim 3 wherein said first and second propelling devices are first and second propellers.

5. The flotation device of claim 4 wherein said hull has left and right keels thereon extending downwardly therefrom and said left and right cranks have left and right crankshafts, said left and right crankshafts respectively extending through said left and right keels, said first and second propellers being on first and second propeller shafts, said first and second propeller shafts each having a gear thereon and said left and right crankshafts each having a gear thereon, said crankshafts gears and said propeller shaft gears being interengaged so that rotation of said left crankshaft causes a higher rotative speed in said first propeller shaft.

6. The flotation device of claim 2 further including a cushion on said hull.

7. A flotation device comprising:

a hull, said hull having a hull body having a top wall and a bottom wall, said top wall being configured to have a person rest thereon in prone position, said hull having left and right keels extending downwardly below said bottom wall thereto;

a left crankshaft extending through said left keel and a right crankshaft extending through said right keel, a left crank on said left crankshaft, said left crank being positioned outboard of said hull, a right crank on said right crankshaft, said right crank being positioned outboard of said hull, said cranks being positioned so that a person lying on said hull in prone position can manually engage said cranks and crank said crankshafts;

left and right propulsion structure respectively engaged to be driven by said left and right crankshafts, said left and right propulsion structure being in propulsion engagement with water when said hull is floating on water so that a person lying on said hull can separately energize said left and right propulsion structure by separate cranking of said left and right cranks.

8. The flotation device of claim 7 wherein said left and right propulsion structure comprises left and right propellers.

9. The flotation device of claim 8 wherein said connection between said left crankshaft and said left propeller includes speedup gearing and said connection between said right crankshaft and said right propeller includes separate speedup gearing.

10. The flotation device of claim 7 further including a survival suit configured to be worn by a person and attachment structure for disengageable attachment of said survival suit and said hull so that a person wearing said survival suit can attach himself to said flotation device.

11. The flotation device of claim 7 further including a cushion attached to said flotation device so that a person lying prone thereon is cushioned with respect to said flotation device.

12. A flotation device comprising:

a hull, said hull being configured as a hollow hull made of synthetic polymer composition material, left and right keels extending downward from said bottom wall;

left and right manually operated structures respectively mounted on said left and right keels so that said manually operated structures are positioned to be conveniently accessible to a person lying prone on said hull;

propulsion structure beneath said hull, said propulsion structure being connected to said left and right manually engageable structures so that manual actuation of said manually engageable structure causes motion of said propulsion structure to propel said flotation device and the person thereon.

13. The flotation device of claim 12 wherein said propulsion structure comprises at least one propeller to be positioned in water when said hull is floating on water.

14. The flotation device of claim 12 wherein said propulsion structure comprises left and right propellers, said left and right propellers being respectively attached to said left and right manually operated structure so that actuation of said left manually operated structure causes rotation of said left propeller and manual actuation of said right manually operated structure causes actuation of said right propeller so that steering of said flotation device can be accomplished by separate actuation of said left and right manually operated structure.

15. The flotation device of claim 14 wherein said left and right manually operated structures comprise left and right cranks respectively on left and right crankshafts and said left and right crankshafts are respectively rotatably mounted on said left and right keels.

16. The flotation device of claim 12 further including a survival suit sized and configured to be worn in water to at least partially protect the person wearing said survival suit from heat loss to water and detachable connectors between said survival suit and said hull.

17. The flotation device of claim 15 further including a survival suit sized and configured to be worn in water to at least partially protect the person wearing said survival suit from heat loss to water and detachable connectors between said survival suit and said hull.

18. The flotation device of claim 15 further including a cushion on said hull.

* * * * *